US011454063B2

(12) United States Patent
Shan et al.

(10) Patent No.: US 11,454,063 B2
(45) Date of Patent: Sep. 27, 2022

(54) MOUNTING STRUCTURE FOR ROLLER BLIND

(71) Applicants: Caihua Shan, Taizhou (CN); Yucheng Shan, Taizhou (CN)

(72) Inventors: Caihua Shan, Taizhou (CN); Yucheng Shan, Taizhou (CN)

(73) Assignee: Zhejiang Shengge Technology Co., Ltd., Taizhou (CN)

( * ) Notice: Subject to any disclaimer, the term of this patent is extended or adjusted under 35 U.S.C. 154(b) by 0 days.

(21) Appl. No.: 17/238,235

(22) Filed: Apr. 23, 2021

(65) Prior Publication Data

US 2022/0186556 A1 Jun. 16, 2022

(51) Int. Cl.
*E06B 9/42* (2006.01)

(52) U.S. Cl.
CPC ..... *E06B 9/42* (2013.01)

(58) Field of Classification Search
CPC ..... E06B 9/42; E06B 9/66; E06B 9/46
USPC ..... 160/368.1
See application file for complete search history.

(56) References Cited

U.S. PATENT DOCUMENTS 4,197,896 A * 4/1980 Reichstadt ..... E06B 9/17023 160/133
4,649,980 A * 3/1987 Kunz ..... E06B 9/24 160/310
4,828,002 A * 5/1989 Ashby ..... E06B 9/323 403/381
5,515,901 A * 5/1996 Hall ..... E06B 3/481 160/206
6,431,247 B1 * 8/2002 Harrison, Jr. ..... E06B 9/323 52/39
6,712,115 B2 * 3/2004 Judkins ..... E06B 9/264 160/84.01
7,134,469 B2 * 11/2006 Drew ..... E06B 9/42 248/273
7,516,771 B2 * 4/2009 Drew ..... E06B 9/323 248/220.21
7,743,813 B2 * 6/2010 Haffamier ..... A47H 13/00 160/39

(Continued)

FOREIGN PATENT DOCUMENTS

CN 200978614 Y 11/2007
CN 201535130 U 7/2010

(Continued)

*Primary Examiner* — Beth A Stephan
(74) *Attorney, Agent, or Firm* — Minder Law Group; Willy H. Wong

(57) ABSTRACT

The present invention provides a mounting structure for a roller blind, comprising a blind body and an upper beam located at the top of the blind body; the mounting structure comprises: a fixing beam to be fixed on a predetermined wall, a plurality of hangers and a protruding engaging strip provided on the upper beam; a back side of the upper beam is engaged to the fixing beam, and a front side of the upper beam is connected to the fixing beam by means of the hangers; a top of the limit plate is reached upwardly and embedded into the fixing beam, and with cooperation of the gravity of the blind body, limits the hangers. The mounting structure for a roller blind provided by the present invention has the advantages of convenient installation and dismantlement of the roller blind and good stability of the roller blind after installation.

11 Claims, 4 Drawing Sheets

(56) References Cited

U.S. PATENT DOCUMENTS

| | | | | |
|---|---|---|---|---|
| 7,900,680 | B2 * | 3/2011 | Garmyn | E06B 9/42 160/321 |
| 2008/0121353 | A1 * | 5/2008 | Detmer | E06B 9/90 160/311 |
| 2011/0114809 | A1 * | 5/2011 | Ng | E06B 9/42 248/309.1 |
| 2013/0313392 | A1 * | 11/2013 | Sanchuk | A47H 2/00 248/254 |
| 2014/0048218 | A1 * | 2/2014 | Ng | E06B 9/42 160/293.1 |
| 2016/0051074 | A1 | 2/2016 | Chou | |
| 2018/0202223 | A1 | 7/2018 | Lin | |
| 2019/0048657 | A1 | 2/2019 | Huang | |

FOREIGN PATENT DOCUMENTS

| | | | | |
|---|---|---|---|---|
| CN | 204081952 | U | 1/2015 | |
| CN | 106050114 | A | * 10/2016 | E06B 9/42 |
| CN | 205801112 | U | 12/2016 | |
| CN | 205955621 | U | 2/2017 | |
| CN | 208159517 | U | 11/2018 | |
| CN | 110761697 | A | 2/2020 | |
| DE | 19738333 | A1 | 3/1999 | |
| EP | 1302620 | A2 | 4/2003 | |

* cited by examiner

MOUNTING STRUCTURE FOR ROLLER BLIND

RELATED APPLICATIONS

This application claims priority to Chinese Patent Application No. CN202011465160.5, filed Dec. 14, 2020.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention pertains to the technical field of roller blinds and relates to a mounting structure for a roller blind.

BACKGROUND

Roller blinds for windows and doors are widely used in daily life. Such roller blinds have an upper beam at a top thereof. Installation of such a roller blind is generally done by firstly drilling holes on a mounting wall, then inserting expansion screws through the upper beam and tightening the screws into the holes to secure the upper beam to the mounting wall. However, this drilling-and-screwing method makes installation of a roller blind quite troublesome and dismantlement inconvenient.

To cope with the above problems, various improvements have been made, and some of them have been applied for patents, for example, one prior art discloses a Roman blind that can be easily installed, comprising: a blind body; an upper beam, which is to be installed on a top part of the blind body; a hanging rod, which is to be mounted and fixed on a predetermined wall surface; and at least one movable articulation member, which is to be installed on a predetermined part of the upper beam and capable of movably attaching/detaching the upper beam to/from the hanging rod.

The Roman blind of such a structure can be quickly installed and dismantled through the movable articulation member. However, in the Roman blind of such a structure, the upper beam, after being attached through the movable articulation member, has a problem of rotation and translation relative to the hanging rod, causing a problem of the blind body deviating from a preset position, resulting in the blind body not playing a good blocking role. Therefore, when the blind body is pulled out, it is often necessary to readjust the position of the Roman blind, which brings inconvenience to use.

SUMMARY

Some objectives of one embodiment of the present invention are to provide a mounting structure for a roller blind with respect to the above defects in the prior art, to solve the technical problem of how to make a roller blind convenient to install and dismantle and to ensure the roller blind has good stability after installation.

The objectives of the present invention can be achieved by the following technical solution: in one embodiment of a mounting structure for a roller blind, the roller blind comprising a blind body and an upper beam capable of accommodating the blind body, the mounting structure comprising a fixing beam to be fixed on a wall and located on a top of the upper beam, wherein the mounting structure further comprises a plurality of hangers, so that a back side of the upper beam is hooked to the fixing beam while a front side of the upper beam is attached to the fixing beam by the hangers; wherein the fixing beam has provided thereon a first groove capable of being hooked to one end of the hangers; and wherein the upper beam has provided thereon an upwardly protruding limit plate capable of abutting against one side wall of the hangers under gravity and limiting the hangers to be within the first groove.

The fixing beam can be fixed on a wall beforehand; afterward, when the roller blind needs to be installed, an operator firstly connects a top of the hangers to the fixing beam, so that one end of the hangers is hooked to the fixing beam. Then, the operator hand-holds the upper beam to make a back side of the upper beam hooked to the fixing beam at a hooking position, and then, the operator rotates the upper beam around the hooking position to move it upward, so that, under the joint gravity of the upper beam and the blind body, the limit plate on a front side of the upper beam is attached to abut against a side wall of the hangers, thus limiting the hangers to be within the first groove and at the same time connecting the hangers to the upper beam, and finally making the roller blind mounted on the fixing beam. When dismantling, the operator only needs to reverse the above installation operations, thus making dismantlement of the roller blind convenient. In the present invention, the back side of the upper beam is directly hooked to the fixing beam, while the front side of the upper beam is hooked to the fixing beam by means of the hangers; as the hangers are limited by the limit plate to be within the first groove, the hangers cannot be rotated and thus prevented from falling out of the first groove, which ensures stability of the hangers with regard to hanging on the fixing beam. At the same time, under the joint gravity of the upper beam and the blind body, the limit plate is attached to abut against a side wall of the hangers, so that the limit plate together with the hangers will not rotate, thus the upper beam is prevented from rotating around any hooking position (which acts as an articulation point) on either side of the upper beam, this ensures stability of the upper beam after installation, therefore, the roller blind will not rotate, translate or fall off after installation; hence, the roller blind has good stability after installation.

In one embodiment of the above mounting structure for a roller blind, the fixing beam has provided on a bottom of the fixing beam a recessed second groove; the upper beam has provided thereon a protruding engaging strip; the engaging strip reaches into the second groove so that the back side of the upper beam is hooked to the fixing beam. By simply pushing the upper beam to let the engaging strip reach into the second groove, the back side of the upper beam is hooked to the fixing beam, thus making installation and dismantlement of the roller blind convenient.

In one embodiment of the above mounting structure for a roller blind, the first groove is provided recessed on the bottom of the fixing beam; the upper beam has provided thereon a recessed third groove; a top of the hangers is hooked into the first groove and a bottom of the hangers is hooked into the third groove, so that the hangers are attached to the fixing beam, and that a top of the limit plate reaches upwardly into the first groove. When installing, the top of the hangers is hung in the first groove; next, the upper beam is engaged and rotated to move upward, causing the limit plate to firstly push away the hangers; then, when the top of the limit plate reaches upward into the first groove, the bottom of the hangers reaches into and hooks in the third groove, thus the upper beam is secured to the bottom of the fixing beam; therefore, installation of the roller blind is convenient. When dismantling, one only needs to push the upper beam in a preset direction, so that the upper beam and the fixing beam are slightly staggered, to cause the hangers to detach from the upper beam, thus dismantlement of the roller blind is convenient.

In one embodiment of the above mounting structure for a roller blind, each of the hangers comprises a flat-shaped main body, with a first end of the main body being bent towards a first side to form a hanging strip, while a second end of the main body being bent towards a second side to form a lifting strip; when the upper beam is secured to the bottom of the fixing beam, the hanging strip is located within the first groove, the lifting strip is located within the third groove, and the main body is attached to abut against the limit plate. This structure of the hanging strip and the lifting strip makes the hangers play a better role in connecting the upper beam with the fixing beam, thus improving stability of the upper beam after being connected to the fixing beam; moreover, by making the main body attached to abut against the limit plate, it improves stability of the hangers and also prevents the hangers from rotating or falling off, thus further improving stability of the upper beam after being connected to the fixing beam; therefore, the roller blind has good stability after installation.

In one embodiment of the above mounting structure for a roller blind, a sum of a thickness of the main body and a thickness of the limit plate is slightly less than a width of an opening of the first groove. This structure makes the top of the hangers and the top of the limit plate can reach into the first groove, and also makes the hangers not deflect or easily fall off, thus improving stability of the roller blind after installation.

In one embodiment of the above mounting structure for a roller blind, when the upper beam is secured to the bottom of the fixing beam, a gap is present between the top of the limit plate and a bottom of the first groove. When dismantling, the upper beam needs to be pushed in a preset direction. The gap is set so that the upper beam has a certain amount of deflection, thus facilitating dismantlement of the roller blind.

In one embodiment of the above mounting structure for a roller blind, both the hanging strip and the lifting strip are in a shape of a strip; the included angle between the hanging strip and the main body is an acute angle, while the first groove has provided therein an inclined hanging surface; the included angle between the lifting strip and the main body is an acute angle, while the third groove has provided therein an inclined lifting surface; when the upper beam is secured to the bottom of the fixing beam, the hanging strip is attached to abut against the hanging surface, and the lifting strip is attached to abut against the lifting surface. This structure realizes good stability of the upper beam after being connected to the fixing beam by the hangers, and makes the hangers not easy to deflect or fall off, thus improving stability of the roller blind after installation.

In one embodiment of the above mounting structure for a roller blind, the first groove has provided at an opening of the first groove a protruding hanging portion, and the hanging surface is located on the hanging portion. The hanging portion provides a position for hanging, and at the same time the hanging portion is set so that the opening of the first groove is narrowed, making the hangers and limit plate not easy to fall out.

In one embodiment of the above mounting structure for a roller blind, the first groove, the third groove, the limit plate, the hanging strip and the lifting strip are all in a shape of an elongated strip; the abutting surfaces of both the limit plate and the main body are all flat, so that when the upper beam is secured to the bottom of the fixing beam, application of an external force is capable of making the hangers move along the limit plate. By moving positions of the hangers to make the hangers evenly arranged, it can improve stability of the upper beam after being connected to the fixing beam, thus improving stability of the roller blind after installation.

In one embodiment of the above mounting structure for a roller blind, both the second groove and the engaging strip are in a shape of an elongated strip and have a cross section in a shape of an angle iron, and the second groove has provided at an opening of the second groove a protruding engaging portion; when the upper beam is secured to the bottom of the fixing beam, the engaging strip is wholly located within the second groove, and the engaging portion is located within a cavity enclosed by the engaging strip and the upper beam. This structure makes the engaging strip easy to reach into the second groove, and also after that, makes the upper beam and the fixing beam abut against and support each other, thus improving stability of the roller blind after installation.

In one embodiment of the above mounting structure for a roller blind, the upper beam has a backing strip at the top of the upper beam, while the fixing beam has a backing surface at the bottom of the fixing beam; when the upper beam is secured to the bottom of the fixing beam, the backing strip is attached to abut against the backing surface, or a gap is present between the backing strip and the backing surface. This structure makes the upper beam not easy to deflect or move relatively after being connected to the fixing beam, thus further improving stability of the upper beam after being connected to the fixing beam, and improving stability of the roller blind after installation.

In one embodiment of the above mounting structure for a roller blind, the fixing beam has provided thereon a protruding and angle-iron shaped placement strip fixedly connected thereto, with a receiving groove being formed between the placement strip and the fixing beam. The receiving groove can be used to place items therein, or can be used to fit with other parts to work together.

Compared to the prior art, one embodiment of the mounting structure for a roller blind provided by the present invention has the following advantages:

1. The roller blind of the present invention does not require screws or holes for installation and does not need to be customized beforehand, only the fixing beam needs to be installed beforehand, and the roller blind can be installed at any time when needed, therefore, it is convenient to use.

2. The roller blind of the present invention is convenient to install by hooking and positioning and with synergy between the gravity of the roller blind itself and the structure of the hangers, so that the upper beam of the roller blind is automatically hooked and positioned after being connected to the bottom of the fixing beam; when dismantling, one only needs to push the roller blind in a preset direction to cause the hangers to detach, therefore, dismantlement is convenient.

3. The hangers of the roller blind of the present invention are free to slide, and their suitable positions can be selected according to actual needs, this further improves stability of the upper beam after being connected to the fixing beam, thus improving stability of the roller blind after installation.

DETAILED DESCRIPTION

Set forth below are specific embodiments of the present invention and a further description of the technical solutions of the present invention in conjunction with the accompanying drawings, but the present invention is not limited to these embodiments.

Figure 1:
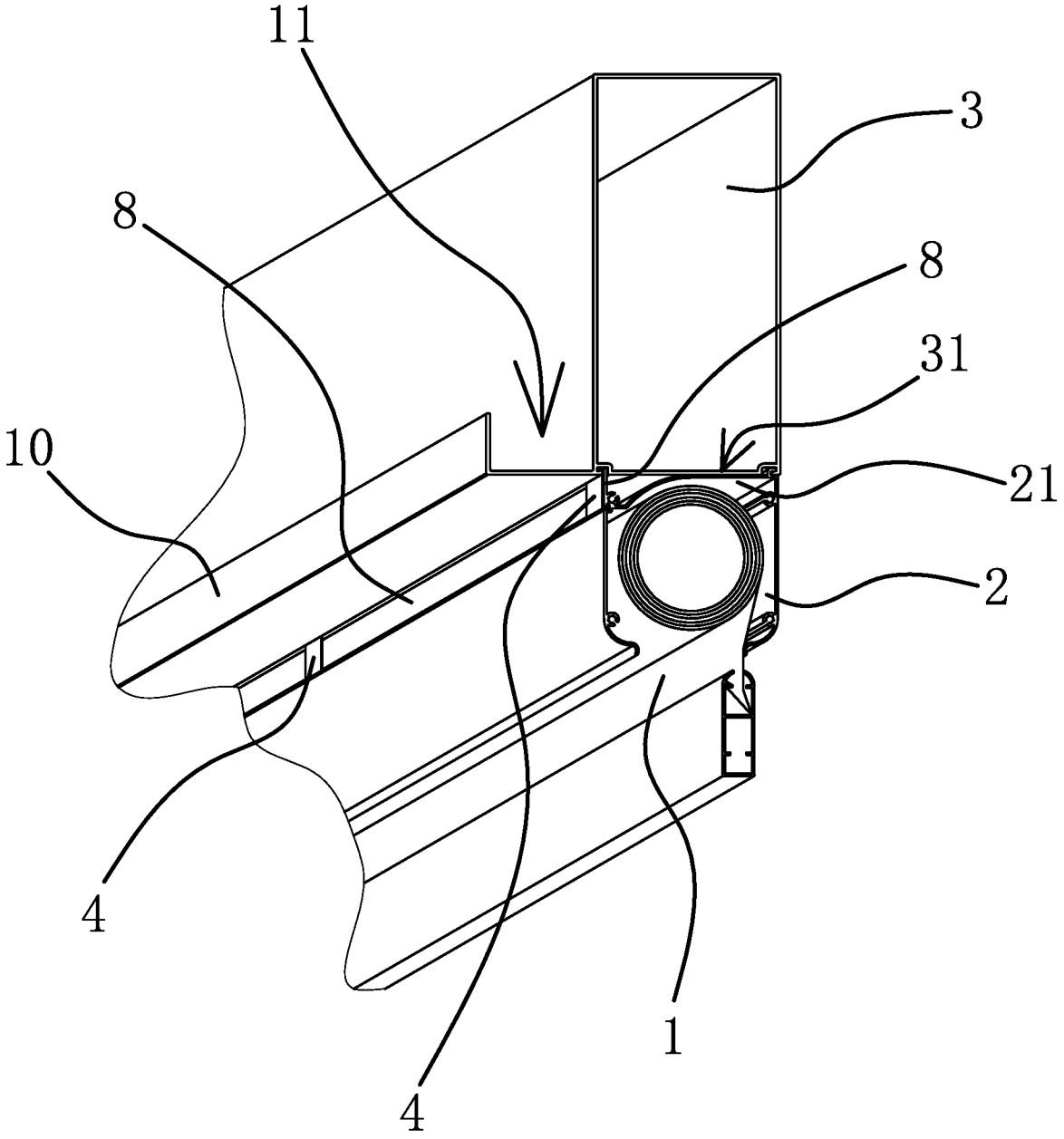
FIG. 1 is a partial perspective view of one embodiment of the roller blind of the present invention after installation.
Figure 2:
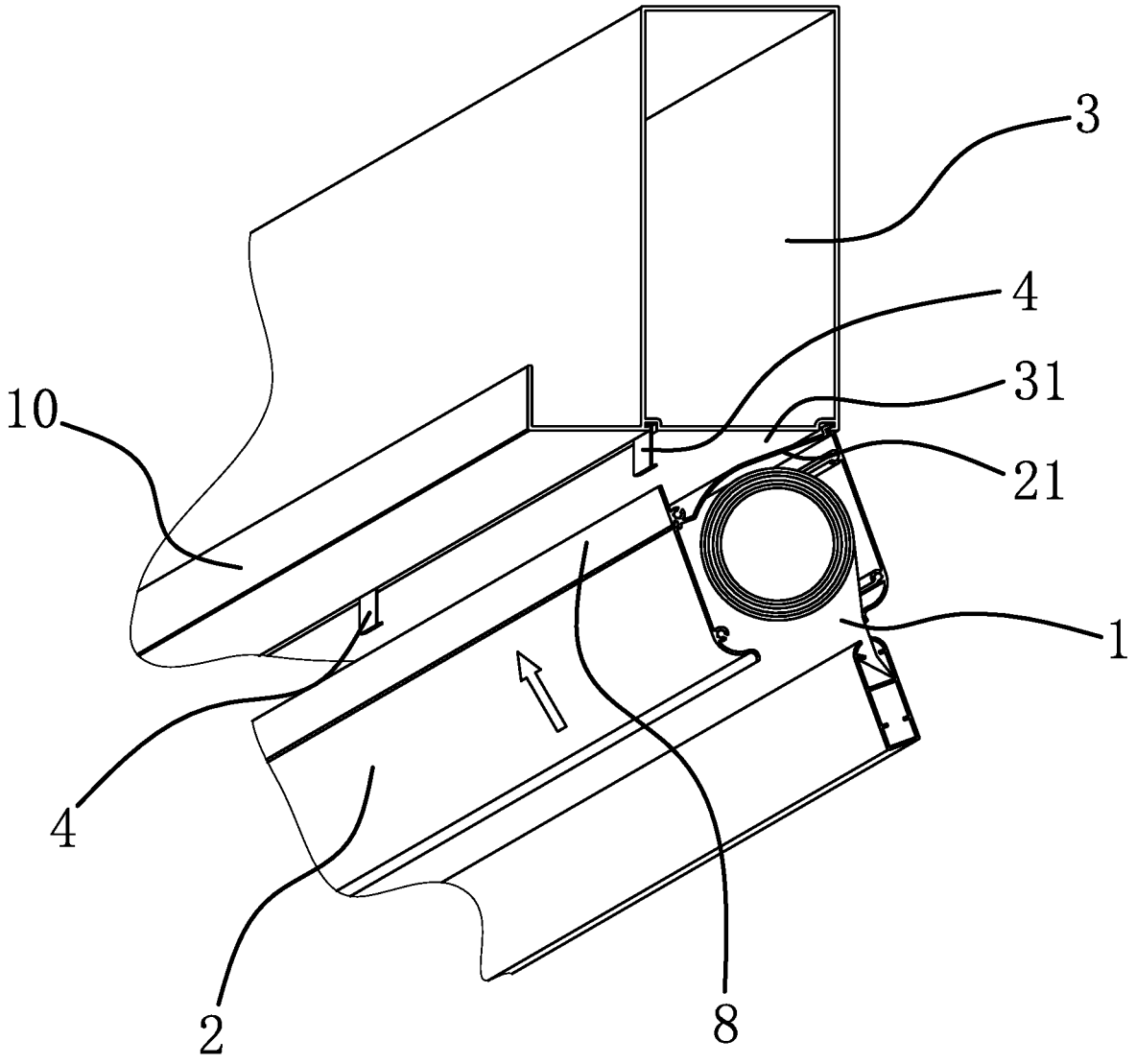
FIG. 2 is a partial perspective view of one embodiment of the roller blind of the present invention during installation.

As shown in FIGS. 1 and 2, one embodiment of a roller blind comprises a blind body 1 and an upper beam 2 located on a top of the blind body 1. One embodiment of a mounting structure comprises: a fixing beam 3 to be fixed on a wall, and a plurality of hangers 4. The fixing beam 3 has provided thereon a protruding and angle-iron shaped placement strip 10 fixedly connected thereto, with a receiving groove 11 being formed between the placement strip 10 and the fixing beam 3.

The fixing beam 3 has provided on a bottom of the fixing beam a first groove 6 and a second groove 5 which are both recessed and in a shape of an elongated strip with a cross section in a shape of an angle iron. The second groove 5 has provided at an opening of the second groove a protruding engaging portion 51, which is set so that a width of the opening of the second groove 5 is less than a width of a bottom of the second groove; the first groove 6 has provided at an opening of the first groove a protruding hanging portion 62, which has provided thereon an inclined hanging surface 61 and is set so that a width of the opening of the first groove 6 is less than a width of a bottom of the first groove.

The upper beam 2 has provided thereon a protruding engaging strip 7, a limit plate 8 and a recessed third groove 9, which all are in a shape of an elongated strip, but the engaging strip 7 has an angle-iron shaped cross section, the limit plate 8 has a sheet shaped cross section, and the third groove 9 has provided therein an inclined lifting surface 91. The hanger 4 comprises a flat-shaped main body 41, with a first end of the main body 41 being bent towards a first side to form a hanging strip 42, while a second end of the main body 41 being bent towards a second side to form a lifting strip 43, both the hanging strip 42 and the lifting strip 43 being in a shape of an elongated strip, the included angle between the hanging strip 42 and the main body 41 being an acute angle, and the included angle between the lifting strip 43 and the main body 41 being also an acute angle.

When the upper beam 2 is secured to the bottom of the fixing beam 3, because the upper beam 2 has a backing strip 21 at a top of the upper beam and the fixing beam 3 has a backing surface 31 at the bottom of the fixing beam, a gap is present between the backing strip 21 and the backing surface 31 in this embodiment, and the gap may be 1 mm, however, in practice, the backing strip 21 may be attached to abut against the backing surface 31.

Figure 4:
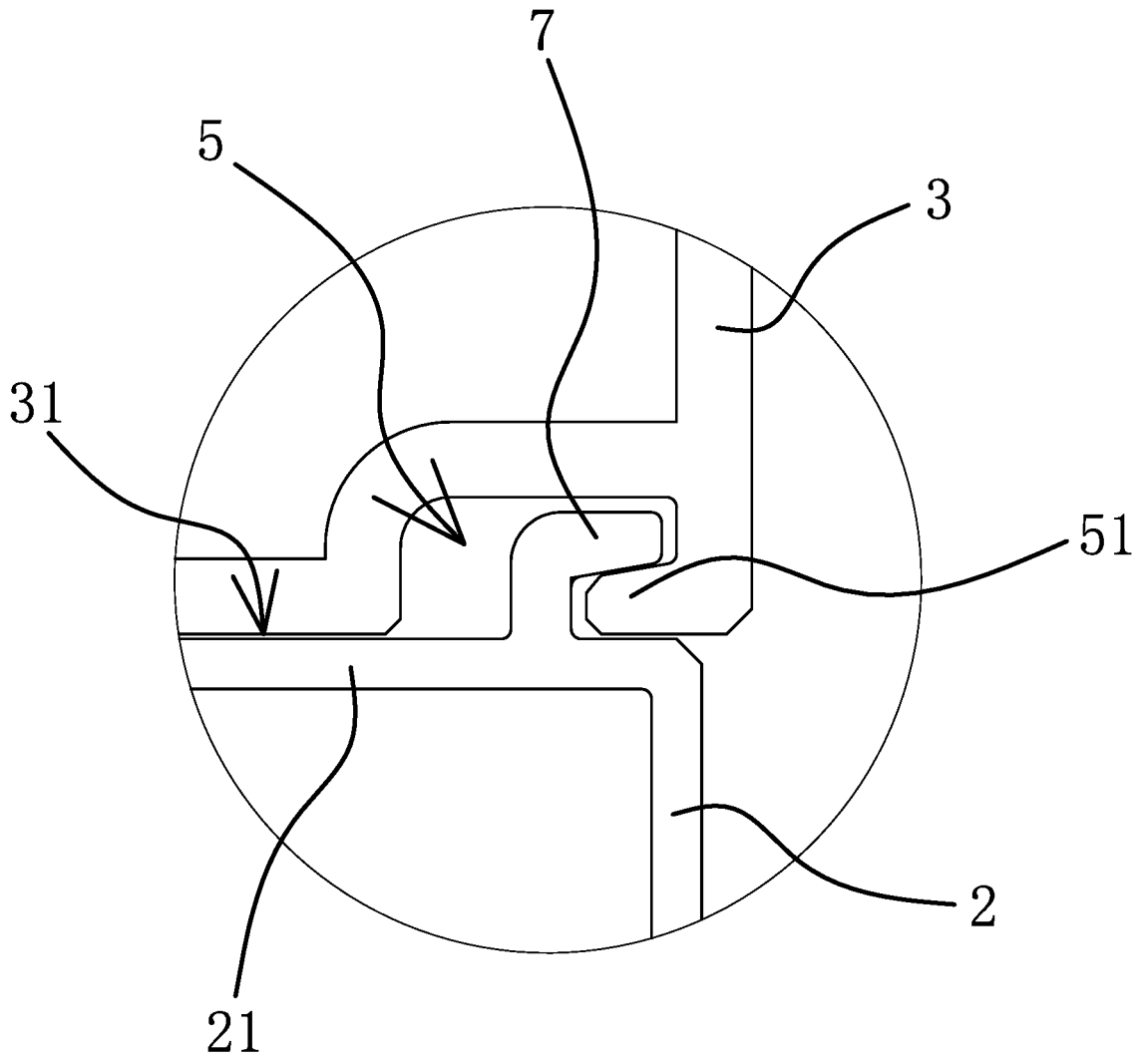
FIG. 4 is a cross-sectional view of one embodiment of a connection between the engaging strip and the second groove of the roller blind of the present invention.

As shown in FIG. 4, one embodiment of the engaging strip 7 is wholly located within the second groove 5, and the engaging portion 51 is located within a cavity enclosed by the engaging strip 7 and the upper beam 2, so that a back side of the upper beam 2 is hooked to the fixing beam 3.

Figure 3:
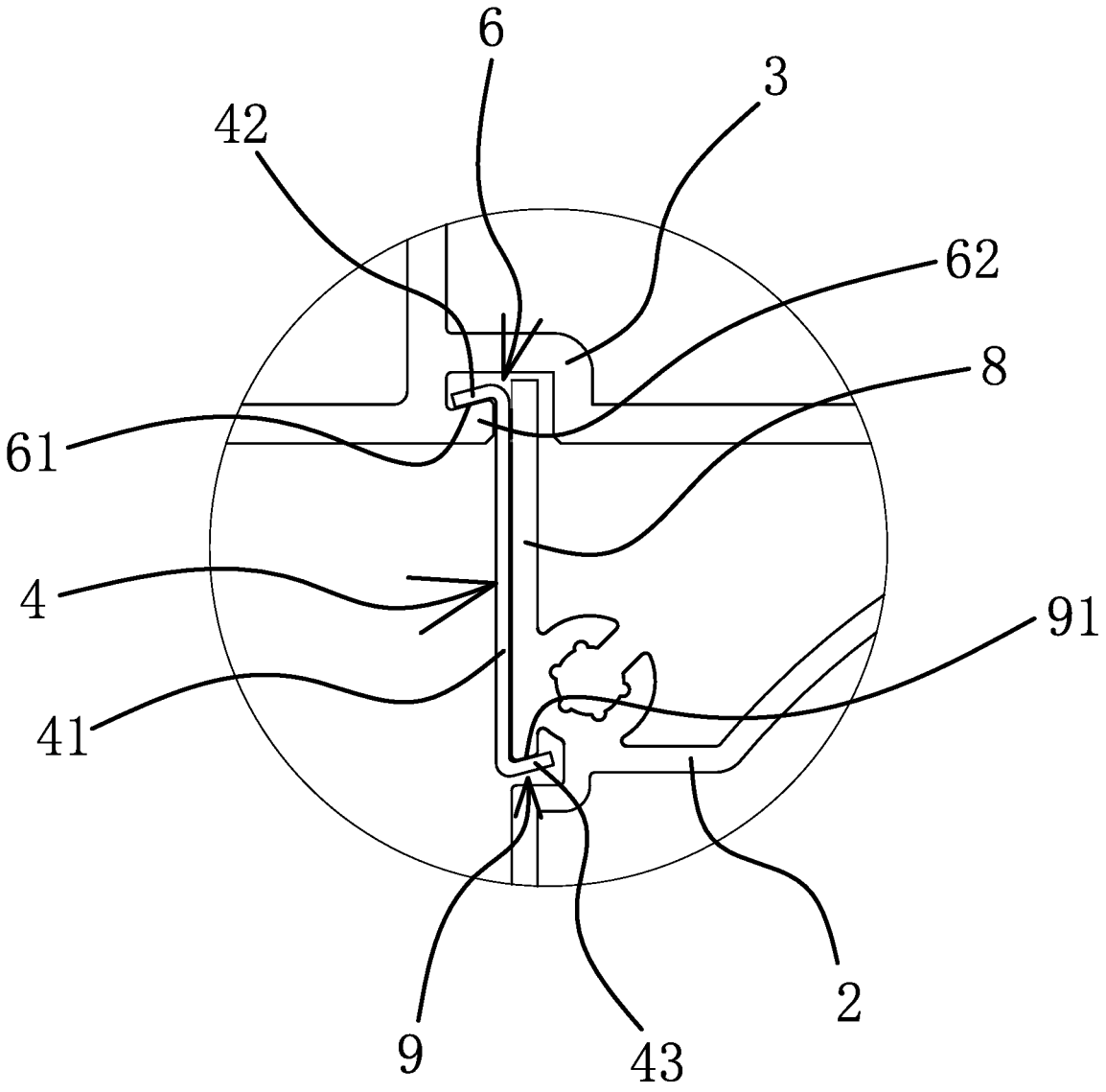
FIG. 3 is a cross-sectional view of one embodiment of a connection at the hangers and at the limit plate of the roller blind of the present invention.

As shown in FIG. 3, a top of one embodiment of the limit plate 8 reaches upwardly into the first groove 6, with a gap being present between the top of the limit plate 8 and the bottom of the first groove 6; the hanging strip 42 is located within the first groove 6 and attached to abut against the hanging surface 61, and the lifting strip 43 is located within the third groove 9 and attached to abut against the lifting surface 91; the main body 41 is attached to abut against the limit plate 8; in this way, a front side of the upper beam 2 is secured to the bottom of fixing beam 3. The abutting surfaces of both the limit plate 8 and the main body 41 are all flat, and a sum of a thickness of the main body 41 and a thickness of the limit plate 8 is slightly less than the width of the opening of the first groove 6; therefore, application of an external force is capable of making the hangers 4 move along the limit plate 8.

Meanwhile, an avoidance gap is present between the lifting strip 43 and a lower side wall of the third groove 9, so that during dismantlement of the roller blind, the upper beam 2 can be hand-held to move upward, and this avoidance gap can be used to, when a bottom of the limit plate 8 is detached from the lifting strip 43 formed at a bottom of the hangers 4, avoid that the lifting strip 43 abuts against the lower side wall of the third groove 9, thus facilitating the hangers 4 using the hanging strip 42 formed at a top of the hangers 4 as an articulation point to rotate to cause the lifting strip 43 to fall out of the third groove 9, thus overcoming gravity and releasing its connection with the upper beam 2; therefore, dismantlement is convenient.

The fixing beam 3 is fixed to a wall beforehand; afterward, when the roller blind needs to be installed, an operator firstly lets the hanging strip 42 of the hangers 4 reach into the first groove 6 and abut against the hanging surface 61 on the hanging portion 62, then, the operator hand-holds the upper beam 2 and lets the engaging strip 7 on the upper beam 2 reach into the second groove 5, so that the back side of the upper beam 2 is hooked to the fixing beam 3 at a hooking position; next, the operator rotates the upper beam 2 around the hooking position to move it upward, so that the limit plate 8 pushes away the hangers 4 and makes the top of the limit plate 8 reach into the first groove 6, then, the operator makes the lifting strip 43 of the hangers 4 reach into the third groove 9, so that, under the gravity of the upper beam 2 and the blind body, the limit plate 8 abuts with its lower end against the lifting strip 43 and is attached to abut against a side wall of the hangers 4, thus the upper beam 2 is secured to the bottom of the fixing beam 3; in this way, installation of the roller blind is completed. When dismantling, the operator only needs to push the upper beam 2 in a preset direction, so that the upper beam 2 and the fixing beam 3 are slightly staggered, to cause the hangers 4 to detach from the upper beam 2; therefore, dismantlement of the roller blind is convenient.

The specific embodiments described herein are merely illustrative of the spirit of the present invention. Technicians skilled in the art to which the present invention pertains can make various modifications or additions to the specific embodiments described or replace them in a similar manner, without departing from the spirit of the present invention or beyond the scope defined by the appended claims.

REFERENCED PARTS

1 Blind Body
2 Upper Beam

21 Backing Strip
3 Fixing Beam
31 Backing Surface
4 Hanger
41 Main Body
42 Hanging Strip
43 Lifting Strip
5 Second Groove
51 Engaging Portion
6 First Groove
61 Hanging Surface
62 Hanging Portion
7 Engaging Strip
8 Limit Plate
9 Third Groove
91 Lifting Surface
10 Placement Strip
11 Receiving Groove

The invention claimed is:

1. A mounting structure for a roller blind with a blind body, the mounting structure comprising:

an upper beam capable of accommodating the blind body;

a fixing beam to be fixed on a wall and located on a top of the upper beam; and a plurality of hangers, so that a back side of the upper beam is hooked to the fixing beam while a front side of the upper beam is attached to the fixing beam by the hangers;

wherein the fixing beam has provided thereon a first groove, one end of each of the hangers is capable of being hooked to the first groove;

wherein the upper beam has provided thereon an upwardly protruding limit plate; and wherein when the end of each of the hangers is hooked into the first groove, the limit plate abuts against one side wall of the hangers under gravity and prevents the hangers from rotating, thus preventing the end of each of the hangers from falling out of the first groove.

2. The mounting structure for a roller blind according to claim 1 wherein the fixing beam has a recessed second groove on a bottom of the fixing beam;

wherein the upper beam has provided thereon a protruding engaging strip; and wherein the engaging strip extends into the second groove so that the back side of the upper beam is hooked to the fixing beam.

3. The mounting structure for a roller blind according to claim 1 wherein the first groove is recessed on a bottom of the fixing beam;

wherein the upper beam has provided thereon a recessed third groove; and wherein a top of the hangers is hooked into the first groove and a bottom of the hangers is hooked into the third groove, so that the hangers are attached to the fixing beam, and that a top of the limit plate extends upwardly into the first groove.

4. The mounting structure for a roller blind according to claim 3 wherein each of the hangers comprises a flat-shaped main body, with a first end of the main body being bent towards a first side to form a hanging strip, while a second end of the main body is bent towards a second side to form a lifting strip; and wherein when the upper beam is secured to the bottom of the fixing beam, the hanging strip is located within the first groove, the lifting strip is located within the third groove, and the main body is attached to abut against the limit plate.

5. The mounting structure for a roller blind according to claim 4 wherein a sum of a thickness of the main body and a thickness of the limit plate is slightly less than a width of an opening of the first groove.

6. The mounting structure for a roller blind according to claim 1 wherein when the upper beam is secured to a bottom of the fixing beam, a gap is present between a top of the limit plate and a bottom of the first groove.

7. The mounting structure for a roller blind according to claim 4 wherein both the hanging strip and the lifting strip are in a shape of a strip;

wherein an included angle between the hanging strip and the main body is an acute angle, while the first groove has an inclined hanging surface;

wherein an included angle between the lifting strip and the main body is an acute angle, while the third groove has an inclined lifting surface; and wherein when the upper beam is secured to the bottom of the fixing beam, the hanging strip is attached to abut against the hanging surface, and the lifting strip is attached to abut against the lifting surface.

8. The mounting structure for a roller blind according to claim 4 wherein the first groove, the third groove, the limit plate, the hanging strip and the lifting strip are all in a shape of an elongated strip; and wherein abutting surfaces of both the limit plate and the main body are all flat, so that when the upper beam is secured to the bottom of the fixing beam, application of an external force is capable of making the hangers move along the limit plate.

9. The mounting structure for a roller blind according to claim 2 wherein both the second groove and the engaging strip are in a shape of an elongated strip and have a cross section in a shape of an angle iron, and the second groove has a protruding engaging portion at an opening of the second groove; and wherein when the upper beam is secured to the bottom of the fixing beam, the engaging strip is wholly located within the second groove, and the engaging portion is located within a cavity enclosed by the engaging strip and the upper beam.

10. The mounting structure for a roller blind according to claim 1 wherein the upper beam has a backing strip at the top of the upper beam, while the fixing beam has a backing surface at a bottom of the fixing beam; and wherein when the upper beam is secured to the bottom of the fixing beam, the backing strip is attached to abut against the backing surface.

11. The mounting structure for a roller blind according to claim 1 wherein the upper beam has a backing strip at the top of the upper beam, while the fixing beam has a backing surface at a bottom of the fixing beam; and wherein when the upper beam is secured to the bottom of the fixing beam, a gap is present between the backing strip and the backing surface.

* * * * *